US007334297B2

(12) United States Patent
Ma et al.

(10) Patent No.: US 7,334,297 B2
(45) Date of Patent: Feb. 26, 2008

(54) HINGE ASSEMBLY FOR FOLDABLE ELECTRONIC DEVICE

(75) Inventors: Ming-Feng Ma, Shenzhen (CN); Rui-Hao Chen, Shenzhen (CN); Chia-Hua Chen, Tu-Cheng (TW)

(73) Assignees: Shenzhen Futaihong Precision Industrial Co., Ltd., BaoAn District, Shenzhen, Guangdong Province (CN); Sutech Trading Limited, Road Town, Tortola (BV)

( * ) Notice: Subject to any disclaimer, the term of this patent is extended or adjusted under 35 U.S.C. 154(b) by 70 days.

(21) Appl. No.: 11/269,787

(22) Filed: Nov. 8, 2005

(65) Prior Publication Data

US 2006/0096064 A1 May 11, 2006

(30) Foreign Application Priority Data

Nov. 11, 2004 (CN) ..... 2004 1 0052252

(51) Int. Cl.
*E05F 1/08* (2006.01)

(52) U.S. Cl. ..... 16/348; 16/303

(58) Field of Classification Search ..... 16/297, 16/300, 303, 308, 337–343, 348, 347, 330, 16/328; 379/433.13; 455/575.1, 575.3, 455/90.3; 361/680–683
See application file for complete search history.

(56) References Cited

U.S. PATENT DOCUMENTS

| | | | | |
|---|---|---|---|---|
| 4,788,746 | A * | 12/1988 | Idler | 16/297 |
| 6,292,980 | B1 | 9/2001 | Yi et al. | |
| 6,609,273 | B1 * | 8/2003 | Yamada et al. | 16/332 |
| 6,647,593 | B2 * | 11/2003 | Iguchi et al. | 16/386 |
| 6,678,539 | B1 * | 1/2004 | Lu | 455/575.1 |
| 2006/0112516 | A1 * | 6/2006 | Chen et al. | 16/330 |

* cited by examiner

*Primary Examiner*—Robert J. Sandy
(74) *Attorney, Agent, or Firm*—Morris Manning Martin LLP; Tim Tingkang, Esq.

(57) ABSTRACT

A hinge assembly (100) for a foldable electronic device includes a shaft (1), a housing (5) defining a guiding groove (56) therein, a spring (2), and a pin (7). A first end of the spring is coupled to the shaft, and an opposite second end of the spring is coupled to the housing. A first end of the pin is coupled to the shaft, and an opposite second end of the pin is slidable along the guiding groove of the housing. The shaft is rotatable relative to the housing between a first position where the second end of the pin is located in a first position of the guiding groove and a second position where the second end of the pin is located in a second position of the guiding groove. The hinge assembly is thus integrated into a complete unit which is capable of providing a wide range of rotation.

20 Claims, 5 Drawing Sheets

HINGE ASSEMBLY FOR FOLDABLE ELECTRONIC DEVICE

FIELD OF THE INVENTION

The present invention relates to a hinge assembly, and particularly to a hinge assembly for a foldable electronic device such as a mobile phone, an electronic notebook, and so on.

GENERAL BACKGROUND

Hinge assemblies are widely used in foldable electronic devices such as mobile phones and electronic notebooks. These foldable electronic devices typically include two housings. Normally, one of the housings called a main body contains most of the electronic elements of the foldable electronic device. The other housing called a cover contains fewer or even no electronic elements. The hinge assembly is used to interconnect the main body and the cover, and to enable the cover to be foldable relative to the main body.

One kind of hinge mechanism is illustrated in FIG. 5. The hinge mechanism 500 includes: a cam 510, having a wedge-shaped portion 512 on one end thereof, and an engaging portion 514 on the other end thereof which is used for engaging with a cover of a foldable mobile phone; a corresponding cam follower 520 having two jaws 522; and a spring 530 for pressing the cam follower 520 to urge against the cam 510. The cam 510, the cam follower 520 and the spring 530 are received in a hinge housing 540, which is, in turn, covered by a hinge cover 550. The hinge housing 540 and hinge cover 550 are engaged with a body of the foldable mobile phone. In use, the wedge-shaped portion 512 moves along the jaws 522. The cam 510 together with the cover rotates relative to the body of the foldable mobile phone in a predetermined direction. However, the range of rotation of the cover is limited. In addition, the rotation of the hinge mechanism is unstable.

What is needed, therefore, is a hinge assembly which is capable of providing a wide range of rotation and stable rotation.

SUMMARY

A hinge assembly is provided. In a preferred embodiment, a hinge assembly according to the present invention comprises: a shaft, a housing defining a guiding groove therein, a spring, and a pin. A first end of the spring is coupled to the shaft, and an opposite second end of the spring is coupled to the housing. A first end of the pin is coupled to the shaft, and an opposite second end of the pin is slidable along the guiding groove of the housing. The shaft is rotatable relative to the housing between a first position where the second end of the pin is located in a first position of the guiding groove and a second position where the second end of the pin is located in a second position of the guiding groove.

A main advantage of the hinge assembly is that an extent of rotation of the cover of the foldable electronic device is limited by the sliding groove of the housing of the hinge assembly, so that the main body of the foldable electronic device is not bumped or damaged when a user opens the cover of the foldable electronic device. The cover can open to different angles to the main body of the foldable electronic device by way of changing the shape of the sliding groove of the hinge assembly.

Other advantages and novel features will become more apparent from the following detailed description of preferred embodiments when taken in conjunction with the accompanying drawings, in which:

DETAILED DESCRIPTION OF PREFERRED EMBODIMENTS

Figure 1:
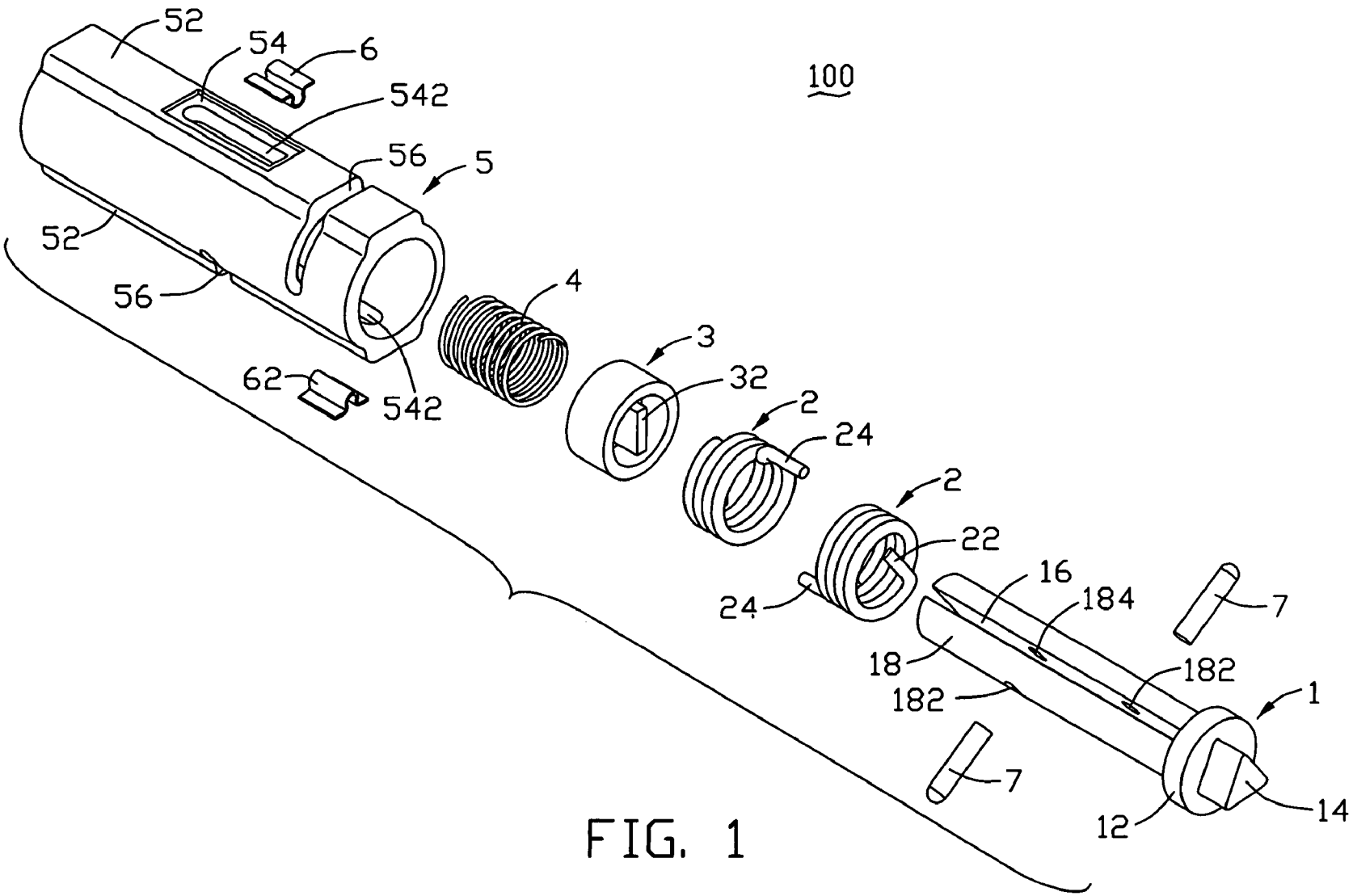
FIG. 1 is an exploded, isometric view of a hinge assembly in accordance with a first embodiment of the present invention.
Figure 2:
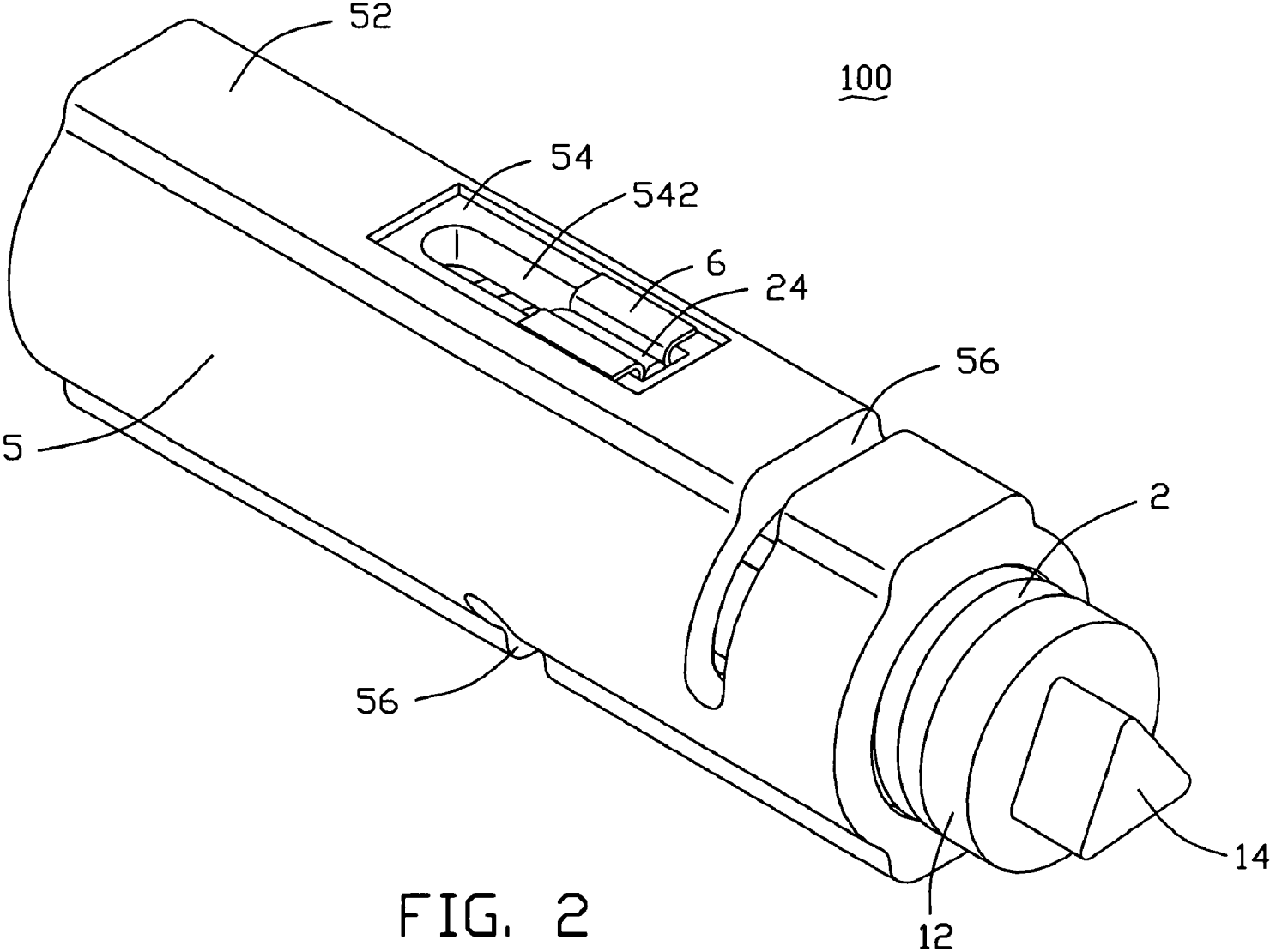
FIG. 2 is an enlarged view of the hinge assembly of FIG. 1 fully assembled.

FIGS. 1 and 2 show a hinge assembly 100 in accordance with a first embodiment of the present invention, which is used to interconnect a main body (not shown) and a cover (not shown) of a foldable electronic device. The hinge assembly 100 includes a shaft 1, two torsional springs 2, a cap 3, an elastic member 4, a housing 5, two retaining tabs 6, and two pins 7.

The shaft 1 is substantially a round rod having a bifurcated portion. The shaft 1 includes a flange 12 at a first end thereof, and an engaging portion 14 formed on the flange 12. The engaging portion 14 is adapted to fixedly engage with the cover of the foldable electronic device, so that the shaft 1 is jointly rotatable with the cover relative to the main body. The bifurcated portion comprises two branches 18, and a gap 16 defined between the branches 18. Each branch 18 defines a through hole 182, and a blind hole 184 spaced a distance from the through hole 182. The through hole 182 of each branch 18 is aligned with the blind hole 184 of the other branch 18. The holes 182, 184 of the branches 18 receive the pins 7 (which will be described in detail below).

The torsional springs 2 have a same structure, and are both cylindrical springs. Each torsional spring 2 has an inner finger 22 and an outer finger 24. The torsional springs 2 surround the shaft 1, with the inner fingers 22 being engaged in the gap 16 of the shaft 1.

The cap 3 is substantially a cylinder, and has an open end and a closed end. A post 32 extends from the closed end to the open end. The post 32 is configured to correspond to the shape of the gap 16 of the shaft 1. The cap 3 is for receiving a second end of the shaft 1, with the post 32 being received in the gap 16 of the shaft 1.

In the illustrated embodiment, the elastic member 4 is a cylindrical compression spring 4. A first end of the compression spring 4 urges against the closed end of the cap 3.

The housing 5 is substantially a hollow cylinder. The housing 5 has an open end and a closed end. Two opposite raised platforms 52 are formed on opposite sides of the housing 5, respectively. The raised platforms 52 are adapted to fixedly engage with the main body of the foldable electronic device, so that the housing 5 is jointly rotatable with the main body relative to the cover. Two recesses 54 are defined in the raised platforms 52, respectively. One recess 54 is configured bias toward the other recess 54. Two slots 542 are defined in bottoms of the recesses 54, respectively. The housing 5 further defines two guiding grooves 56, for receiving the pins 7. One guiding groove 56 is spaced a distance from the other guiding groove 56, as measured along an axial direction of the housing 5. The distance spaced between the guiding grooves 56 is equal to the distance between the through holes 182 of the shaft 1. In the illustrated embodiment, a longitudinal axis of the housing 5 is perpendicular to a main plane of each guiding groove 56.

A central angle subtended by each guiding groove 56 is about 160°. The compression spring 4, the cap 3, the torsional springs 2 and the branches 18 of the shaft 1 are received in the housing 5 in that order. A second opposite end of the compression spring 4 urges against an inner wall of the closed end of the housing 5.

The retaining tabs 6 are generally made of sheets of metallic material. A middle portion of each retaining tab 6 is bent inwardly to form a retaining portion 62. The retaining portions 62 of the retaining tabs 6 are fittingly received in the slots 542 of the housing 5.

The pins 7 are cylinders. First ends of the pins 7 are extended through the through holes 182 and received in the blind holes 184, respectively. Opposite second ends of the pins 7 are received in the guiding grooves 56 of the housing 5, respectively.

Referring to FIG. 2, in assembly of the hinge assembly 100, one torsional spring 2 abuts against the flange 12, with the inner finger 22 of the torsional spring 2 facing toward the flange 12. The other torsional spring 2 abuts against the closed end of the cap 3, with the inner finger 22 of the torsional spring 2 facing toward the cap 3. Within the housing 5, the cap 3 together with the shaft 1 is pressed by an expansion force exerted by the compression spring 4. The outer fingers 24 of the torsional springs 2 are retainably received in the retaining portions 62 of the retaining tabs 6, which, in turn, rest in the slots 542 of the housing 5. The first ends of the pins 7 are fixedly engaged in the blind holes 184, respectively. The second ends of the pins 7 are slidably received in the guiding grooves 56 of the housing 5, respectively.

Once the hinge assembly 100 is assembled to the foldable electronic device, the engaging portion 14 of the shaft 1 is fixedly engaged in a cavity of the cover of the foldable electronic device. The raised platforms 52 of the housing 5 are fixedly engaged in a cavity of the main body of the foldable mobile phone. The cover of the foldable electronic device can be held in closed position relative to the main body of the foldable electronic device by, for example, a mechanical latching mechanism. When the cover is in the closed position, the torsional springs 2 are in a torsional state, the compression spring 4 is in a compressed state, and the second ends of the pins 7 are located at corresponding first ends of the guiding grooves 56 of the housing 5. To open up the foldable electronic device, the cover is unfolded from the main body by releasing the mechanical latching mechanism. The outer fingers 24 of the torsional springs 2 remain in position relative to the housing 5, due to the engagement of the outer fingers 24 and the housing 5. The shaft 1 is jointly rotated with the inner fingers 22 of the torsional springs 22 to an angle of 160° relative to the housing 5, under a torsional force exerted by the torsional springs 2. Correspondingly, the second ends of the pins 7 slide along the guiding grooves 56. The cover of the foldable electronic device is thus automatically fully opened up, and the hinge assembly 100 is in a stable state. To close the cover of the foldable electronic device, the cover is manually rotated back toward the main body. The shaft 1 is jointly rotated with the cover relative to the housing 5. The pins 7 slide from the second ends thereof to the original first ends thereof along the guiding grooves 56. The torsional springs 2 are twisted when the cover is closed down onto the main body and is latched by the mechanical latching mechanism of the foldable electronic device. During the above-described opening and closing processes of the cover, the compression spring 4 is utilized to urge against the cap 3 together with shaft 1, thereby the pins 7 are biased against edges of the guiding grooves 56 while sliding along the guiding grooves 56. Thus, the shaft 1 and the cover are able to rotate stably relative to the housing 5.

Figure 3:
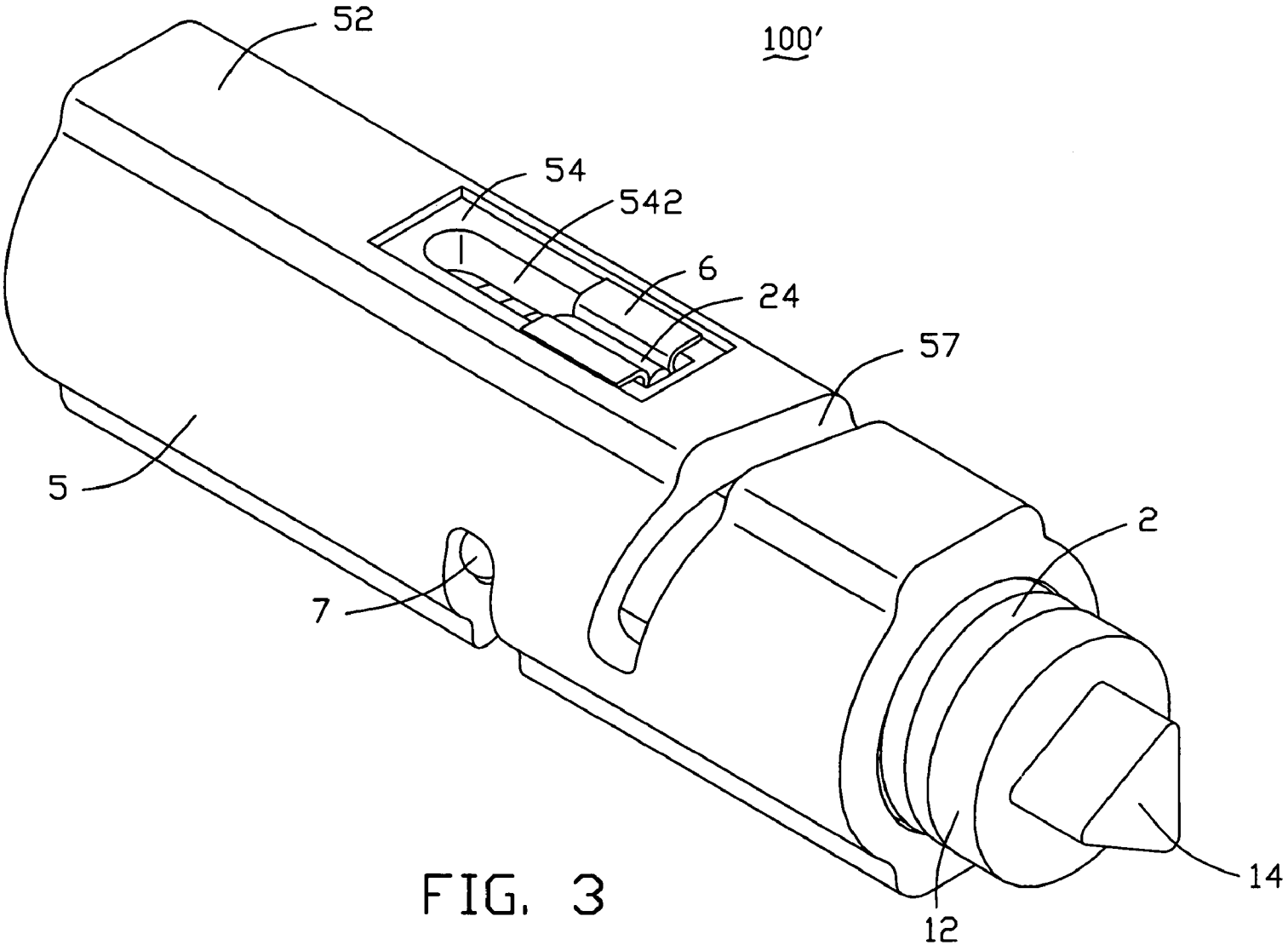
FIG. 3 is an isometric view of a hinge assembly in accordance with a second embodiment of the present invention.

Referring to FIG. 3, a hinge assembly 100' in accordance with a second embodiment of the present invention is shown. Most of the structure of the hinge assembly 100' of the second embodiment is similar to that of the hinge assembly 100 of the first embodiment, except that a longitudinal axis of the housing 5 obliquely intersects a main plane of a guiding groove 57. Thus, when opening up the cover of the foldable electronic device, the shaft 1 is rotated relative to the housing 5 by the torsional force exerted by the torsional springs 2 and the expansion force exerted by the compression spring 4.

Figure 4:
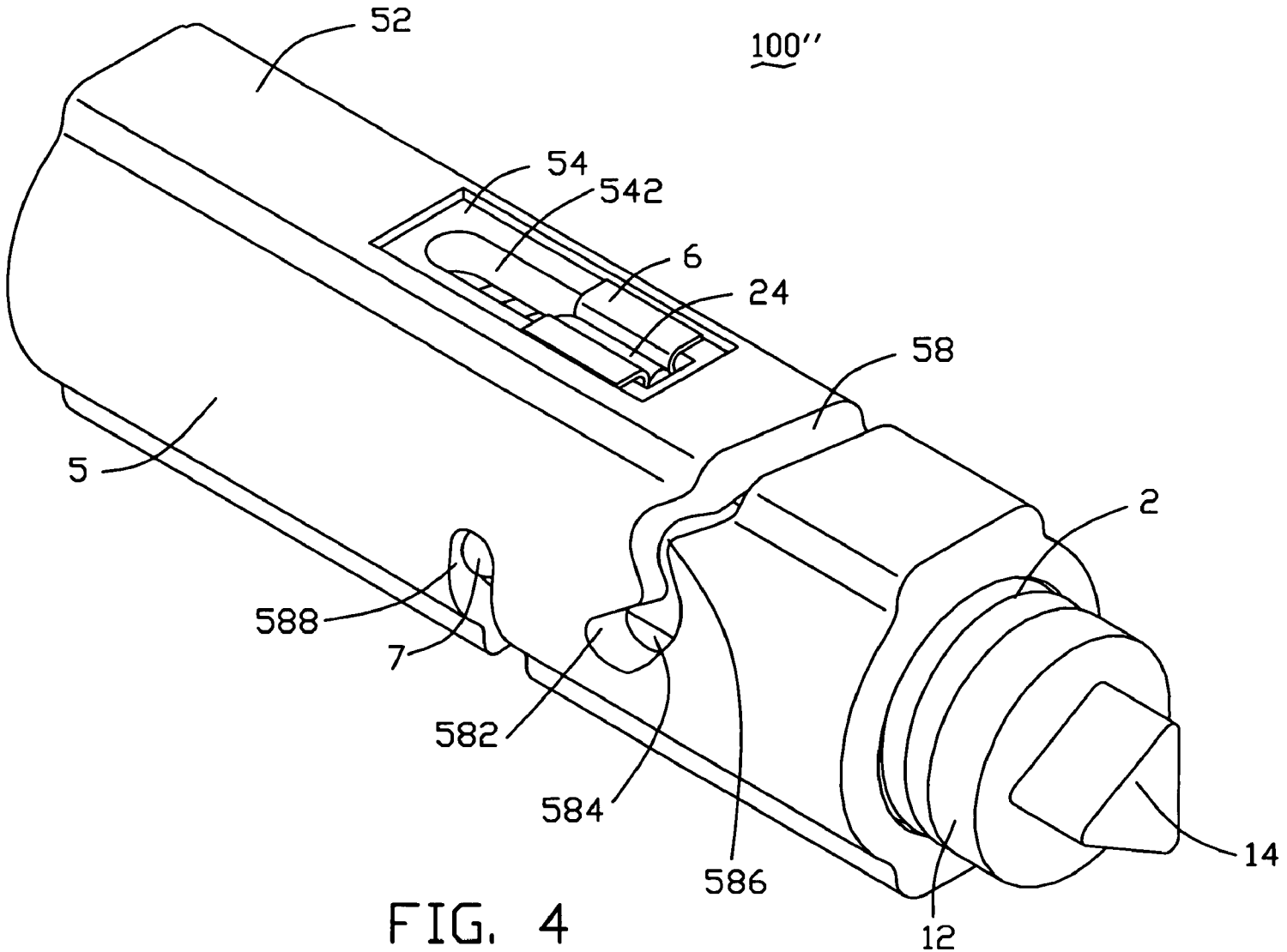
FIG. 4 is an isometric view of a hinge assembly in accordance with a third embodiment of the present invention.
Figure 5:
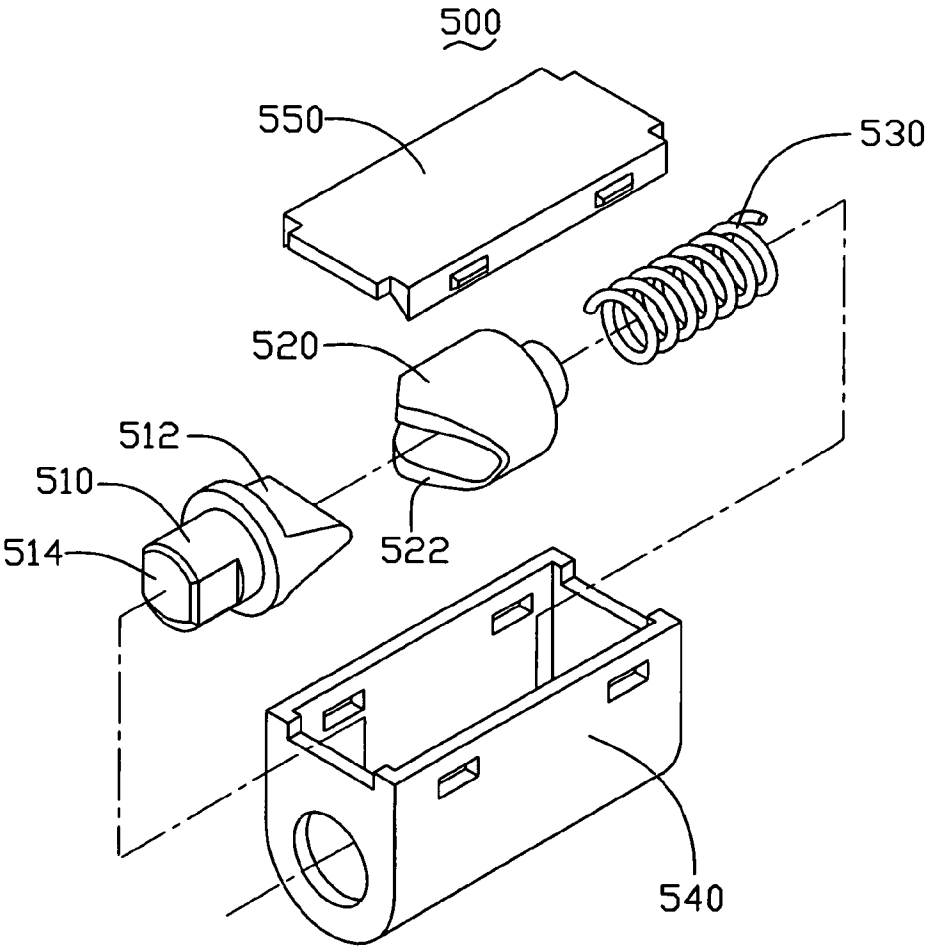
FIG. 5 (RELATED ART)
FIG. 5 is an exploded, isometric view of a conventional hinge assembly.

Referring to FIG. 4, a hinge assembly 100" in accordance with a third embodiment of the present invention is shown. Most of the structure of the hinge assembly 100" is similar to that of the hinge assembly 100, except for the configuration of guiding grooves 58 of the housing 5. Each guiding groove 58 includes a first end 582, a first curved section 584 curved toward the engaging portion 14, and a second curved section 586 curved toward the compression spring 4, and an opposite second end 588. The pins 7 are located at the first ends 582 of the guiding grooves 58 when the cover is in the closed position relative to the main body. When opening up the cover of the foldable electronic device, the shaft 1 is rotated relative the housing 5 by the torsional force exerted by the torsional springs 2 and the expansion force exerted by the compression spring 4. The pins 7 are retained in the second curved sections 586. At this position, the cover is opened up a small angle relative to the main body. When a user manually applies force to the cover, the pins 7 are caused to escape from the second curved section 586. The shaft 1 is then rotated relative to the housing 5 by the torsional force exerted by the torsional springs 2 and the expansion force exerted by the compression spring 4. The cover of the foldable electronic device is then opened up automatically to a fully open position, with the pins 7 sliding from the second curved sections 586 to the second ends 588 of the guiding grooves 58.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A hinge assembly for a foldable electronic device, comprising: a shaft; a housing defining a guiding groove therein; at least one torsional spring having a first end and a second end opposite to the first end, the first end of the torsional spring being coupled to the shaft, and the second end of the torsional spring being coupled to the housing; and a pin having a first end and an opposite second end, the first end of the pin being fixed to the shaft and the pin being unmovable relative to the shaft, and the second end of the pin being slidable along the guiding groove of the housing; wherein, the shaft is rotatable relative to the housing between a first position where the second end of the pin is located in a first position of the guiding groove and a second position where the second end of the pin is located in a second position of the guiding groove.

2. The hinge assembly as claimed in claim 1, wherein a longitudinal axis of the housing is perpendicular to a main plane of the guiding groove of the housing.

3. The hinge assembly as claimed in claim 1, wherein a longitudinal axis of the housing obliquely intersects a main plane of the guiding groove of the housing.

4. The hinge assembly as claimed in claim 1, further comprising an elastic member configured for exerting a force on the shaft.

5. The hinge assembly as claimed in claim 4, wherein the guiding groove includes a first end, an opposite second end, at least one curved section curved away from the elastic member, and at least one curved section curved toward the elastic member.

6. The hinge assembly as claimed in claim 1, wherein an angle subtended by the guiding groove is approximately 160°.

7. The hinge assembly as claimed in claim 1, wherein the shaft comprises a bifurcated portion having two branches and a gap defined between the branches.

8. The hinge assembly as claimed in claim 7, wherein a through hole and a corresponding blind hole are defined in the branches, and the first end of the pin is received in the blind hole.

9. The hinge assembly as claimed in claim 7, wherein a platform is formed on the housing, and the platform defines a slot.

10. The hinge assembly as claimed in claim 9, wherein the hinge assembly further comprises a retaining tab made of metallic material.

11. The hinge assembly as claimed in claim 10, wherein a middle portion of the retaining tab is bent inwardly to form a retaining portion, and the retaining portion is received in the slot of the platform of the housing.

12. The hinge assembly as claimed in claim 11, wherein the torsional spring comprises an inner finger engageably received in the gap of the shaft, and an outer finger retainably received in the retaining portion of the retaining tab.

13. The hinge assembly as claimed in claim 7, further comprising a cap received in the housing, wherein the cap comprises an open end and a closed end.

14. The hinge assembly as claimed in claim 13, wherein the cap further comprises a post extending from the closed end to the open end thereof and the post is engageably received in the gap of the shaft.

15. A foldable electronic device comprising:

a main body;

a cover; and a hinge assembly disposed between said main body and said cover so as to support said cover to be movable relative to said main body, said hinge assembly comprising:

a shaft movable together with one of said main body and said cover and a housing movable together with the other of said main body and said cover;

at least one pin, one end of said at least one pin fixed to said shaft and being unmovable relative to the shaft, an opposite end of said at least one pin received in said housing; and a torsional spring driving one of said housing and said shaft to rotate relative to the other of said housing and said shaft so as to cause said at least one pin to slide in said housing relative to said shaft.

16. The electronic device as claimed in claim 15, wherein said at least one pin roots in said shaft and interferingly engages in a corresponding guiding groove of said housing.

17. The electronic device as claimed in claim 16, wherein said guiding groove includes a first end, a first curved section, a second curved section, and a second end, and said at least one pin slides from the first curved section to the second curved section such that said one of said housing and said cover is retained in a predetermined position relative to said other of said housing and said cover.

18. The electronic device as claimed in claim 17, wherein said at least one pin is configured for escaping from the second curved section when force is applied to said cover, whereupon said shaft is rotated relative to said housing under force of said torsional spring so as to bring said cover to automatically open up to a fully open position relative to said housing.

19. A hinge assembly comprising: a housing defining a peripheral guiding slot therein and an axial slot; a shaft received in the housing; a retaining tab received in the axial slot and slidable in the axial slot; a torsional spring located around the shaft, one end of the torsional spring being fixed to the shaft, and an opposite end of the torsional spring being coupled to the retaining tab; and a pin, one end of the pin being fixed to the shaft, and an opposite end of the pin being received in the peripheral, guiding slot, the pin being unmovable relative to the shaft; wherein one of the housing and the shaft is caused to rotate by force exerted by the torsional spring, and consequently the pin slides along the peripheral guiding slot of the housing.

20. The hinge assembly as claimed in claim 19, wherein the shaft comprises a bifurcated portion having two branches and a gap defined between the branches, the branches respectively define a through hole and a corresponding blind hole, and said one end of the pin is received in the blind hole.

* * * * *